US007905581B2

(12) United States Patent
Kawaguchi et al.

(10) Patent No.: US 7,905,581 B2
(45) Date of Patent: Mar. 15, 2011

(54) INKJET HEAD

(75) Inventors: Shinichi Kawaguchi, Hachioji (JP); Hideo Watanabe, Hachioji (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 113 days.

(21) Appl. No.: 12/436,932

(22) Filed: May 7, 2009

(65) Prior Publication Data

US 2009/0284571 A1 Nov. 19, 2009

(30) Foreign Application Priority Data

May 14, 2008 (JP) ..... 2008-127743

(51) Int. Cl.
*B41J 2/045* (2006.01)
*B41J 2/05* (2006.01)

(52) U.S. Cl. ..... 347/71; 347/58

(58) Field of Classification Search ..... 347/71, 347/68–69, 70, 72, 50, 57, 58; 400/124.14, 400/124.16; 310/311, 324, 327, 365
See application file for complete search history.

(56) References Cited

U.S. PATENT DOCUMENTS

| | | | | |
|---|---|---|---|---|
| 6,568,797 | B2 * | 5/2003 | Yamauchi et al. | 347/71 |
| 7,364,273 | B2 | 4/2008 | Takahashi | |
| 2004/0130602 | A1 | 7/2004 | Watanabe | |
| 2006/0055741 | A1 | 3/2006 | Watanabe et al. | |
| 2007/0070125 | A1 * | 3/2007 | Watanabe | 347/58 |
| 2007/0182787 | A1 * | 8/2007 | Kubo et al. | 347/58 |
| 2008/0117263 | A1 * | 5/2008 | Watanabe | 347/71 |
| 2008/0239010 | A1 * | 10/2008 | Tomita et al. | 347/58 |

FOREIGN PATENT DOCUMENTS

| | | | |
|---|---|---|---|
| EP | 1 923 219 | A2 | 5/2008 |
| JP | 2004-90374 | A | 3/2004 |
| JP | 2006-82396 | A | 3/2006 |

OTHER PUBLICATIONS

Shinichi Kawaguchi et al, "Inkjet head", related U.S. Appl. No. 12/437,095, filed May 7, 2009.
Extended European Search Report dated Aug. 25, 2009 (7 pages), issued in a counterpart European Application of related U.S. Appl. No. 12/437,095.
Extended European Search Report dated Aug. 26, 2009 (7 pages), issued in counterpart European Application Serial No. 09159126.3.

* cited by examiner

*Primary Examiner* — K. Feggins
(74) *Attorney, Agent, or Firm* — Holtz, Holtz, Goodman & Chick, PC

(57) ABSTRACT

On the back surface of a head chip having a plurality of rows of channels (row A, row B), the connection electrodes for row A that are electrically connected to the drive electrodes of the channels of row A are arranged, a first connection electrodes for row B that are electrically connected to the drive electrodes of the channels of row B are arranged between the rows of channels of row A and the rows of channels of row B, and also, between neighboring connection electrodes for row A, a second connection electrodes for row B are separately placed from the first connection electrodes for row B, the first connection electrodes and the second connection electrodes are connected electrically by drawing out interconnections, and the drawing out interconnections are in contact only with the first connection electrodes, the second connection electrodes, and the back surface of the head chip.

11 Claims, 11 Drawing Sheets

INKJET HEAD

RELATED APPLICATION

This application is based on Japanese Patent Application No. 2008-127743 filed with Japanese Patent Office on May 14, 2008, the entire content of which is hereby incorporated by reference.

TECHNICAL FIELD

The present invention relates to inkjet head, and in more detail, to inkjet heads in which it is possible to carry out electrical connection easily between drive circuits and drive electrodes of a head chip having a plurality of rows of channels having all ejecting channels that eject ink.

BACKGROUND

Conventionally, as head chips that deform a driving wall by applying a voltage to the drive electrode formed on the drive walls that segment channels, and that use the pressure generated at that time to eject the ink in the channel from a nozzle, the so called harmonica type head chips are known in which opening parts are provided respectively on the front surface and the back surface.

In such harmonica type head chips, the problem is how to carry out electrical connection between each drive electrode and the drive circuit.

For example, conventionally, an inkjet head has been proposed (Japanese Unexamined Patent Application Publication No. 2004-90374) in which, by providing a penetrating electrode in the cover substrate of the head chip that covers the top part of the channel, the drive electrode inside each channel is brought out to the surface of the cover substrate of the head chip, and the electrical connection between the different drive electrodes and the drive circuit is attempted to be made on the surface of this cover substrate by an FPC, etc., in which the interconnections for driving have been made.

However, providing a penetrating electrode in the cover substrate requires difficult and complicated operations such as, the operation of opening a penetrating hole in the substrate material which is made of a ceramic, etc., and the operation of embedding electrically conductive material inside the penetrating hole, etc. Because of this, an inkjet head has been proposed (Japanese Unexamined Patent Application Publication No. 2006-82396) in which the electrical connections between the different drive electrodes and the drive circuits are made by drawing out and forming, on the back surface of the head chip which is the surface on the side opposite to the surface from which the ink is ejected, connection electrodes that are electrically connected to the different drive electrodes, bonding an interconnection substrate to this back surface of the head chip, and joining an FPC on the edge part of the interconnection substrate.

Forming by drawing out from each channel the interconnection electrodes that are electrically connected to the drive electrodes on the back surface of the head chip in this manner makes it possible to draw out and form the interconnection electrodes easily and also with high accuracy compared to providing penetrating electrodes in the cover substrate, because this can be carried out using the patterning method of the common metal thin films.

However, in the case of a head chip in which higher density is aimed at by providing in parallel two or more rows of channels in a multiple channel construction, since the channel rows are close to one another, it is difficult to draw out the interconnection electrodes up to the edge part of the head chip. For example, in the case of a head chip having two rows of channels, Channel A and Channel B, there is the problem that it is difficult to draw out and form the interconnection electrodes from the channels of row B to the edge part of the head chip on the side that has to go over the channels of row A. This is because it is necessary to go over the channels of row A.

Here, when all the channels of a head chip having a plurality of rows of channels are ejecting channels that eject ink, in general, the channels of the neighboring rows of channels are placed so that they are shifted from each other by half a pitch. In this case, although it is possible to consider carrying out patterning so that the connection electrodes extending from the channels of row B are passed in between the channels of row A and extend up to the edge part of the head chip on the side of that row A, there are the following problems.

When carrying out patterning so that the connection electrodes extending from the channels of row B are passed in between the channels of row A and extend up to the edge part of the head chip on the side of that row A, the connection electrodes are formed in close contact on the drive wall surfaces that face the back surface of the head chip. Because of this, when a drive voltage is applied to the connection electrode during driving, the drive wall is likely to have electrostatic capacitance due to this drive voltage applied to the connection electrode. If the drive wall has electrostatic capacitance, there is the problem that the deformation speed of the drive wall goes down, and it is not possible to obtain the prescribed ink ejecting performance.

Further, in order to pattern connection electrodes between channels, although multilayer formation is done by evaporating the metal for electrode formation after forming a mask covering so as to expose the drive wall surface facing the back surface of the head chip which is the part in which the connection electrode is formed, it is necessary to make the width of the exposed region of the drive wall surface facing the back surface of the head chip smaller than the width of the drive wall in order to acquire the mask adhering region, and also, to prevent short circuits with the drive electrode facing the inside of the channel. As a consequence, it is inevitable that the connection electrode has a shape with a considerably small width compared to the width between the channels, and there is the possibility of the electrical connection being broken.

In view of this, the purpose of the present invention is to provide an inkjet head in which it is possible to carry out easily the electrical connections with FPC, etc., by providing in parallel each of the connection electrodes drawing out from each of the ink channels on the edge part of the back surface of a honeycomb type head chip in which a plurality of rows of channels are provided with all the channels being ejecting channels.

SUMMARY

According to one aspect of the present invention, an inkjet head comprising: a nozzle plate comprising a plurality of nozzles; a head chip comprising: a plurality of rows of channels arranged in parallel to each other, wherein each row of the plurality of rows of channels comprises a plurality of channels arranged in parallel to each other, and a plurality of driving walls each made of piezoelectric member, wherein each of the plurality of channels and each of the plurality of driving walls are provided alternately; a plurality of drive electrodes provided in each of the plurality of channels, wherein the drive walls are deformed to eject ink from the plurality of nozzles by applying a drive voltage to each of the plurality of electrodes; wherein neighboring rows of the plurality of rows are placed so that they are shifted from each other by half a pitch of the channels of the neighboring rows, and each of the plurality of channels are provided with an opening on a front surface of the head chip and an opening on a back surface of the head chip; wherein all the channels of the plurality of channels are ejecting channels that eject ink; wherein when assuming that one of the plurality of rows of channels provided on a side of an end of the head chip is row A and another of the plurality of rows of channels provided next to row A is row B, on the back surface of the head chip, a plurality of connection electrodes for row A that conduct electrically to a plurality of drive electrodes for row A are respectively arranged extending from each of the plurality of channels of row A to the end of the head chip with a pitch equal to the pitch of the channels of row A, and a plurality of first connection electrodes for row B that conduct electrically to a plurality of drive electrodes for row B are respectively arranged between each of the plurality of channels of row A and each of the plurality of channels of the row B with a pitch equal to the pitch of the channels of row B; and wherein a plurality of second connection electrodes for row B are arranged between neighboring connection electrodes for row A among the plurality of connection electrodes for row A with a pitch equal to the pitch of the plurality of first connection electrodes, separately from the plurality of first connection electrodes; and a plurality of wirings adapted to electrically connect the first connection electrodes and the second connection electrodes respectively, wherein the plurality of wirings arranged not to contact the back surface of the head chip except for the first connection electrodes and the second connection electrodes.

DETAILED DESCRIPTION OF THE PREFERRED EMBODIMENTS

The preferred embodiments of the present invention are described below with reference to the figures.

First Preferred Embodiment

Figure 1:
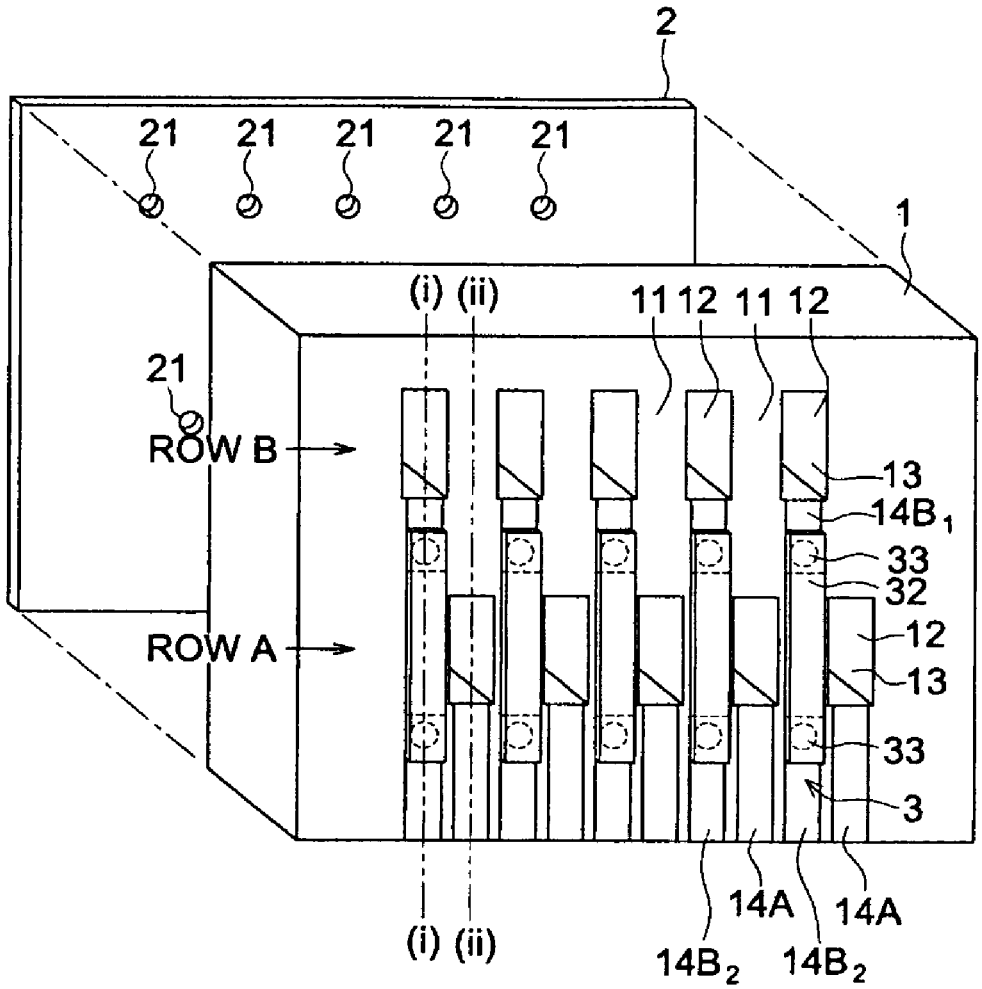
FIG. 1 is a perspective view diagram of an inkjet head according to a first preferred embodiment as seen from the side of the back surface.
Figure 2B:
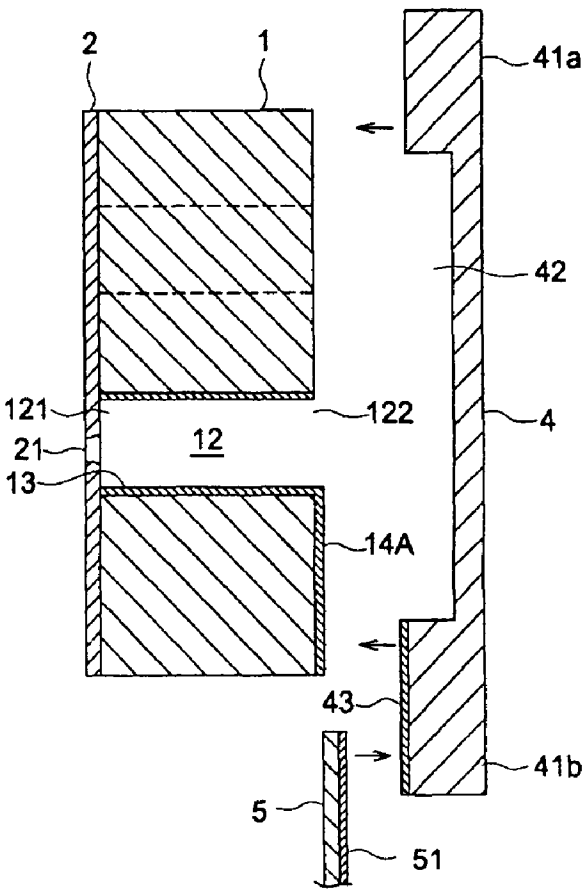
FIG. 2*b* is a cross sectional view diagram at (ii)-(ii) of FIG. 1.
Figure 2A:
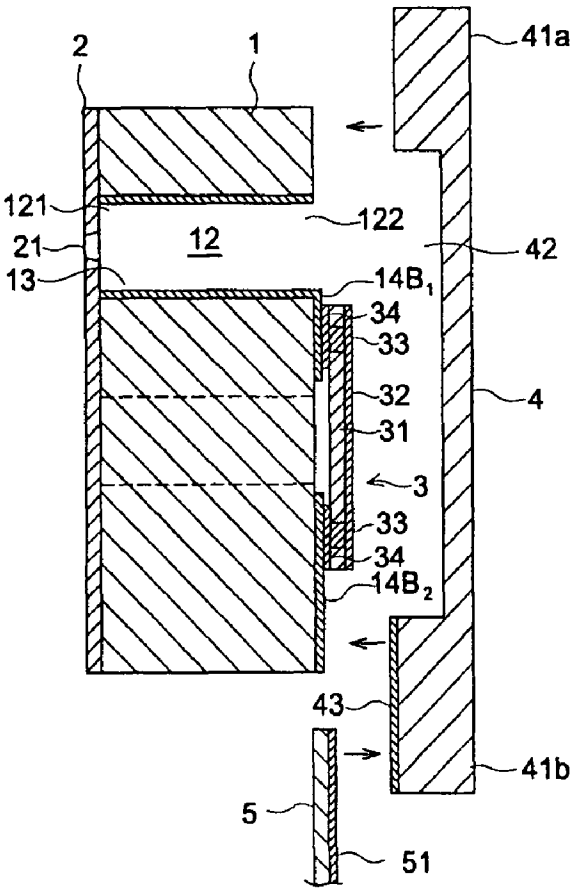
FIG. 2*a* is a cross sectional view diagram at (i)-(i) of FIG. 1.

FIG. 1 is a perspective view diagram of an inkjet head according to a first preferred embodiment as seen from the side of the back surface, FIG. 2*a* is a cross sectional view diagram at (i)-(i) of FIG. 1, and FIG. 2*b* is a cross sectional view diagram at (ii)-(ii) of FIG. 1. Further, in the cross sectional diagrams, the layer of the adhesive has not been shown in the figures.

In the figures, 1 is a head chip, 2 is a nozzle plate bonded on to the front surface of the head chip 1, and 21 are the nozzles formed in the nozzle plate 2.

Further, in the present patent specification, the surface on the side from which ink is ejected from the head chip is referred to as the "front surface" and the surface opposite to that is referred to as the "back surface". In addition, the outside surfaces that are positioned at the top and the bottom in the figures enclosing the channels placed in parallel in the head chip are respectively referred to as the "top surface" and the "bottom surface".

In the head chip 1, two parallel rows of channels at the top and bottom in the figure are provided with drive walls 11 made of a piezoelectric device and channels 12 alternately provided and in parallel in a row of channels. The number of channels in a row of channels is not particularly restricted.

Here, the row of channels positioned on the lower side in the figure is taken as row A and the row of channels positioned on the upper side in the figure is taken as row B.

This head chip 1 includes a plurality of channels 12 of each row of channels those are ejecting channels which eject ink, and each of the channels 12 of row A and the channels 12 of row B have been arranged shifted mutually by half a pitch. In other words, when the head chip 1 is set in the up-down direction in the figure, the placement relationship is such that the channels 12 of row A and the channels 12 of row B are not in a single line, but the gaps between the channels 12 of row A and the channels of row B, or the gaps between the channels 12 of row B and the channels of row A are in line.

The shape of each channel 12 is such that, the walls on both sides extend almost perpendicularly to the top surface and the bottom surface of the head chip 1, and are also mutually parallel. On the front surface and the back surface of the head chip 1, the opening parts 121 at the front surface and the opening parts 122 at the back surface of the respective channels 12 are opposite to each other. Each of the channels 12 is of the straight type in which the size and shape along the longitudinal direction extending from the opening part 122 at the back surface to the opening part 121 at the front surface are almost unchanged.

The entire internal surface of each of the channels 12 is formed to be in close contact the drive electrodes respectively made of a metal film such as of Ni, Au, Cu, Al, etc. Drive electrodes are shown that are formed all over the inner surface of the channels 12 here.

At the back surface of the head chip 1, the connection electrodes 14A for row A that connect electrically to the drive electrodes 13 inside each of the channels 12 of row A are formed in parallel so that they are drawn out with the same pitch as the channels 12 of row A from the channel 12 towards the edge part of the head chip 1 in the downward direction in the figure among the directions that are at right angles to the row of channels (the up and down directions in the figure).

Further, similarly, on the back surface of the head chip 1, not only the first connection electrodes 14$B_1$ for row B that are to be connected electrically to the drive electrodes 13 inside each of the channels 12 of row B are formed from those channels 12 towards row A up to just before the channels 12 of said row A, so that they are formed by drawing them out individually with the same pitch as the channels 12 of row B, but also, the second connection electrodes 14$B_2$ for row B corresponding to each of the channels 12 of row B are formed by drawing out individually so as to be positioned between the neighboring connection electrodes 14A for row A at the edge part of the head chip, and are arranged in a parallel manner so as to be placed alternately with the connection electrodes 14A for row A. The region of forming these second connection electrodes 14$B_2$ for row B is such that, they are formed more towards the edge part of the head chip on the side of said row A than the channels 12 of row A, and are not on the drive walls 11 between the different channels 12 of row A.

These first connection electrodes 14$B_1$ and second connection electrodes 14$B_2$ are the connection electrodes for applying the drive voltages to the drive electrodes 13 inside each of the channels 12 of row B. In other words, at the back surface of the head chip 1, the connection electrodes that are electrically connected to the drive electrodes 13 inside each of the channels 12 of row B, have been arranged by separating them into the first connection electrodes 14$B_1$ and second connection electrodes 14$B_2$. Therefore, it is necessary to connect electrically these first connection electrodes 14$B_1$ and second connection electrodes 14$B_2$. Because of this, in the present invention, these two are being connected electrically using the wirings 32 from the first connection electrodes 14$B_1$ to the second connection electrodes 14$B_2$ while crossing over the row A.

The wiring 32 shown in the present preferred embodiment, as shown in FIG. 2*a*, is formed on one surface of an insulating layer 31 over the entire surface, and a multilayer member 3 is formed along with the wiring 32 and the insulating layer 31. The multilayer member 3 is positioned so that the insulating layer 31 comes on the back surface side of the head chip 1, and with respect to each of the channels of row B, the same number of multilayer members 3 as the number of channels of that row B are adhered individually.

At the two edge parts of each multilayer member 3, in the area where the first connection electrodes 14$B_1$ and the wiring 32 overlap and in the area where the second connection electrodes 14$B_2$ and the wiring 32 overlap, penetrating electrodes 33 that penetrate through the insulating layer 31 are formed respectively. Therefore, although the wiring 32 is electrically connected respectively to the first connection electrode 14$B_1$ and the second connection electrode 14$B_2$ via the penetrating electrodes 33 and 33, and the first connection electrode 14$B_1$ and second connection electrode 14$B_2$ are electrically connected with each other, the wiring is not electrically connected to any other part other than these first connection electrode 14$B_1$ and second connection electrode 14$B_2$, and is also not directly connected with the back surface of the head chip 1. In order to enhance the reliability of electrical conduction, it is also possible to multiple penetrating electrodes 33 respectively in the neighborhood of the two edge parts of the multilayer member 3.

Further, the symbol 34 in FIG. 2*a* refers to multilayer electrodes formed on the side of the surface of the multilayer member 3 that is joined to the head chip 1 at positions corresponding respectively to the first connection electrode 14$B_1$ and the second connection electrode 14$B_2$ for row B in the head chip 1, and by conducting electrically with the penetrating electrodes 33, they ensure definiteness of the electrical connection between the first connection electrode 14$B_1$ and the second connection electrode 14$B_2$ for row B, and indicate a desirable form in the present invention.

Because of these wirings 32, penetrating electrodes 33, and desirably provided multilayer electrodes 34 formed on the multilayer member 3, the connection electrodes of row B connected electrically with the drive electrodes 13 inside each of the channels of row B are formed so that, they pass in between the channels 12 of row A, and are drawn out so that they are parallel to the connection electrodes 14A for row A at the same head chip edge part as the connection electrodes 14A for row A. In other words, because of the wirings 32, penetrating electrodes 33, and desirably provided multilayer electrodes 34, an interconnection is configured in the present invention that electrically connects the first connection electrode 14$B_1$ and the second connection electrode 14$B_2$ for row B.

Next, examples of manufacturing these kinds of inkjet heads are explained below based on FIGS. 3 to 7.

Figure 3A:
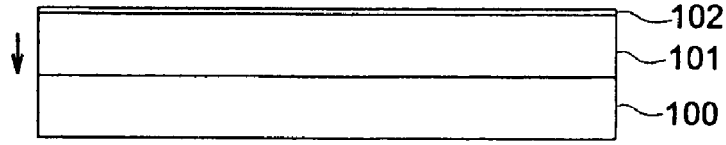
FIGS. 3*a* to 3*e* are diagrams explaining examples of manufacture of an inkjet head.

To begin with, on one substrate 100, a piezoelectric device substrate 101 such as PZT, etc., that has been subjected to polarization treatment (the orientation of polarization is indicated by an arrow mark in the figures) is bonded using an epoxy type adhesive, and in addition, a dry film 102 is pasted on the surface of this piezoelectric device substrate 101 (FIG. 3*a*).

Figure 3B:
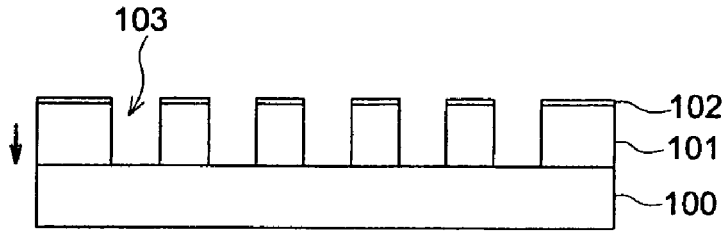

Next, from the side of this dry film 102, a plurality of parallel groves 103 are cut by grinding using a dicing blade, etc. By grinding and cutting each groove 103 so that it extends from one edge part of the piezoelectric device substrate 101 to the other edge part, and also, by grinding for a fixed depth so that the groove extends almost up to the substrate 100, a straight shape is formed whose size and shape are almost unchanged in the longitudinal direction (FIG. 3*b*).

Figure 3C:
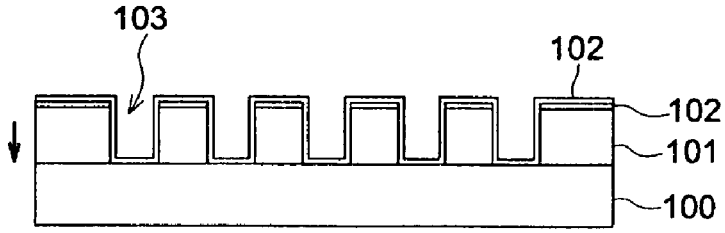

Next, from the side in which the grooves 103 are cut by grinding, a metal film 104 is formed on the top surface of the dry film 102 remaining after cutting by grinding and on the inside surface of each of the grooves 103 using a metal for electrode formation such as Ni, Au, Cu, Al, etc., adopting a method such as the sputtering method, vacuum evaporation method, etc. (FIG. 3*c*).

Figure 3D:
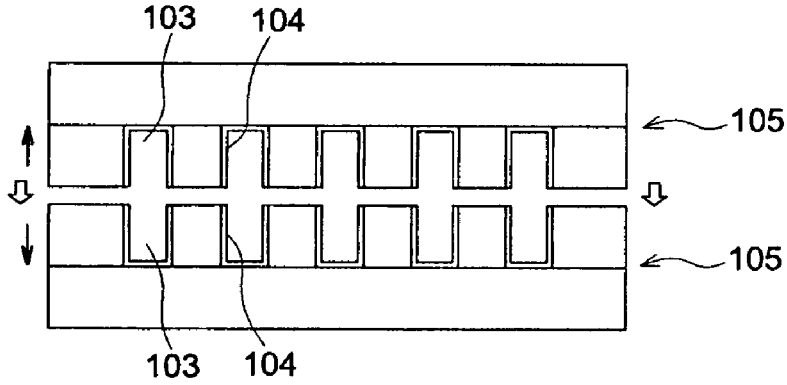

After that, by removing the dry film 102 along with the metal film 104 formed on its surface, a substrate 105 is obtained with a metal film 104 formed only on the inside surface of each of the grooves 103. Further, two of the substrates 105 formed in a similar manner are taken, their positions are adjusted so that the grooves 103 on each of the substrates are matched with each other, and the two substrates are bonded together using an epoxy type adhesive material, etc. (FIG. 3*d*).

Figure 3E:
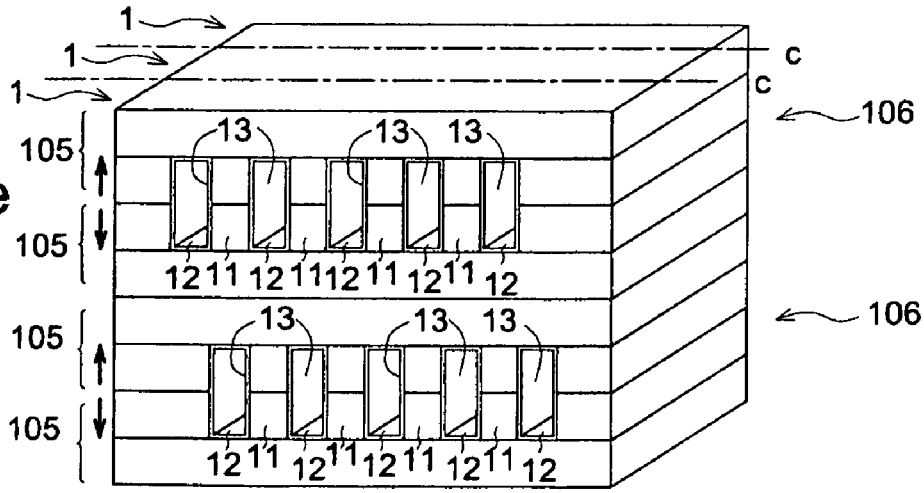

Subsequently, two of the head substrates 106 obtained in this manner are taken, they are placed one on top of the other and bonded after adjusting their positions so that the channels of the two head substrates 106 are shifted from each other by half a pitch, and by cutting in a direction at right angles to the longitudinal direction of the grooves 103, a plurality of pieces of the head chip 1 of the harmonica type having two rows of channels are prepared at once. Each of the grooves 103 becomes a channel 12, and the metal thin film inside each groove 103 becomes the drive electrode 12, and the part between two neighboring grooves 103 becomes the drive wall 11. The width between the cutting lines C and C determines the drive length (length L) of the channels 12 the head chips 1, 1, . . . , prepared by them, and are appropriately determined according to this drive length (FIG. 3*e*).

Figure 4:
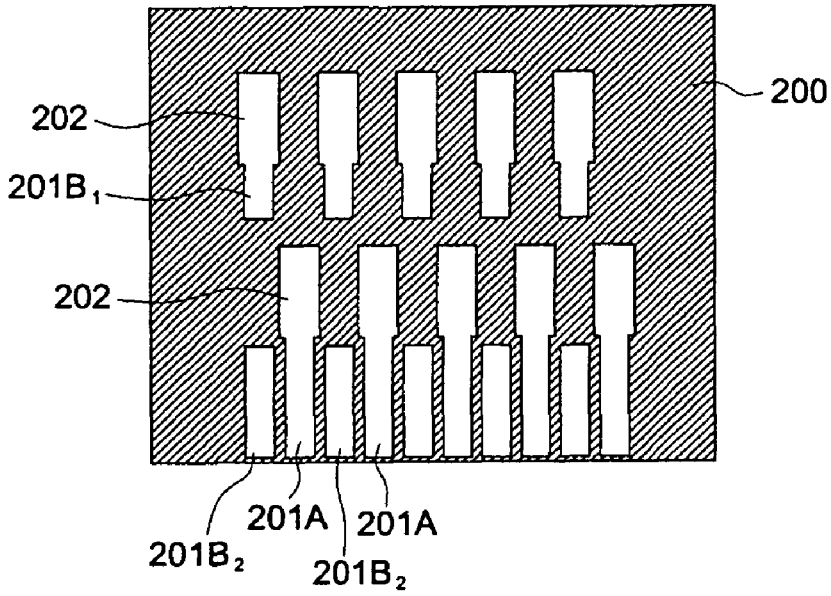
FIG. 4 is a diagram explaining an example of manufacture of an inkjet head.

Next, a dry film 200 is adhered to the back surface of the head chip 1 obtained in this manner, and the opening part 201A for forming the connection electrodes 14A for row A and the opening parts 201$B_1$ and 201$B_2$ for separately forming the first connection electrodes 14$B_1$ and the second connection electrodes 14$B_2$ for row B are formed by exposure and developing (FIG. 4).

Further, from the side of this dry film 200, for example, Al is used as the metal for forming electrodes using the vacuum evaporation method, and an Al thin film is formed selectively and respectively inside each of the openings 201A, 201$B_1$ and 201$B_2$. Because of this Al film, the connection electrodes 14A for row A and the first connection electrodes 14$B_1$ and the second connection electrodes 14$B_2$ for row B are formed on the back surface of the head chip 1.

In order to make definite the connection with the drive electrodes 13 inside each of the channels 12, it is desirable that the vacuum evaporation is done twice by changing the orientation. In concrete terms, from a direction perpendicular to the surface shown in the figure, it is desirable to carry out from directions of 30 degrees to the top and bottom. In addition, as is shown in FIG. 3*d*, in order to make definite the electrical connection between the metal films 104 that are separated into top and bottom ones, it is desirable to carry out vacuum evaporation from a direction at an angle of 30 degrees to the right or left.

Figure 5:
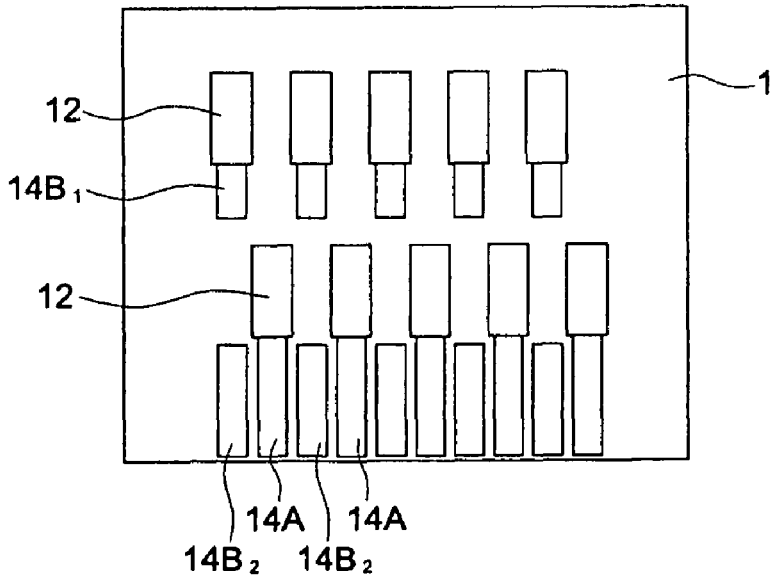
FIG. 5 is a diagram explaining an example of manufacture of an inkjet head.

Further, the method of forming the metal films for forming electrodes need not be restricted to vacuum evaporation, but it is possible to use an ordinary thin film forming method. In addition, it is also possible to use the method of coating a conductive paste by an inkjet. In particular, the sputtering method is ideally suitable because it is possible to form the metal film up to the inside of the channel even without particularly changing the direction since the directions of the flying metal particles is random. After forming the metal film, by dissolving and peeling off the dry film 200 using a solvent, the metal film formed on the dry film 200 is removed, and on the back surface of the head chip 1, only the connection electrodes 14A for row A and the first connection electrodes 14$B_1$ and the second connection electrodes 14$B_2$ for row B will remain (FIG. 5).

Further, considering the ease of operation in the developing process and water washing process of the dry film 200, it is desirable that the dry film 200 has an opening over the entire surface of the channel 12. In FIG. 4, 202 denote an opening which opens over the entire surface of the channel 12. By being open over the entire surface of the channel 12, it becomes easy to remove the developing liquid and cleaning water inside the channels 12.

On the other hand, in order to form the multilayer member 3, on both sides of the organic film that becomes the insulating layer 31, penetrating electrodes 33 are formed in advance for providing electrical connection between the lead wirings 32A for row A, lead wirings 32B for row B, and the multilayer electrodes 34, and between the lead wirings 32B for row B and the multilayer electrodes 34.

Figure 6A:
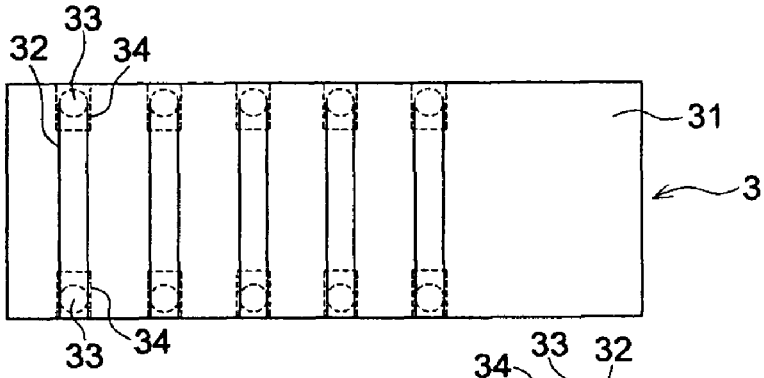
FIGS. 6*a* and 6*b* are diagrams explaining examples of manufacture of an inkjet head.
Figure 6B:
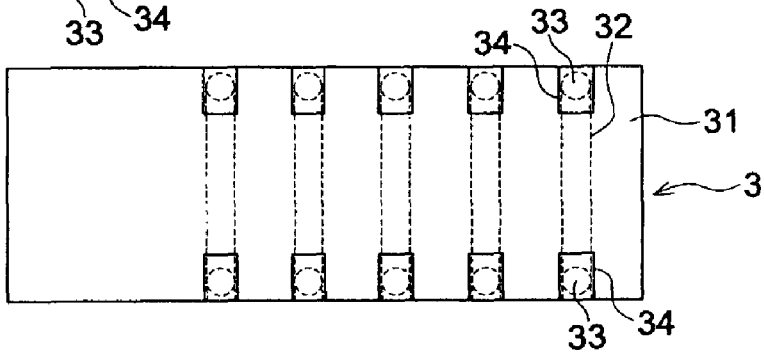

FIG. 6*a* is a plane view diagram as viewed from the side of the wirings 32 the multilayer member 3 with the head chip 1 with the large size before adhering to the head chip 1, and FIG. 6*b* is a plane view diagram as seen from the side of the multilayer electrodes 34 to the multilayer member 3.

In the multilayer member 3 before bonding with the back surface of the head chip 1, the wiring 32, the multilayer electrodes 34, and the penetrating electrode 33 are formed in advance on each surface of the large sized insulating layer 31.

Here, it is desirable to use an organic film for a film to be the insulating layer 31. As an organic film, it is desirable that it is an organic film that can be patterned by ordinary dry etching, and for example, it can be a film made of various types of plastics such as polyimide, liquid crystal polymer, aramid, polyethylene terephthalate, etc. Among them, polyimide film which has good etching characteristics is desirable. Further, in order to make dry etching easy, although it is desirable to use as thin a film as possible, it is also desirable to use an aramid film which has high strength and can retain its strength even when it is thin.

Further, as an insulating layer 31 that can be dry etched, it is also possible to use a silicon substrate. However, for the dry etching of silicon, generally the cost becomes high because it is necessary to use special gases such as $CF_4$ or $SF_6$, etc., and even the apparatus becomes special.

From the point of view of acquiring strength and ease of dry etching, it is desirable that the thickness of the insulating layer 31 is 3 to 100 μm.

The wirings 32 formed on this insulating layer 31 function as connector to electrically connect the first connection electrodes 14$B_1$ and the second connection electrodes 14$B_2$ via the penetrating electrodes 33 and preferably provided multilayer electrodes 34, and also function as the masking materials during the dry etching process. Although it is possible to consider Al, Cu, Ni, W, Ti, Au, etc., as the metals that can be used for each of these lead wirings 32A and 32B, among these, Cu is desirable because it is inexpensive and even patterning is also easy, and it is possible to form the Cu film by sputtering and to form the different wirings 32 and multilayer electrodes 34 by an ordinary thin film patterning technology.

From the point of view of resistance to dry etching and ease of patterning, it is desirable that the thickness of each of these wirings 32B and multilayer electrodes 34 is 0.1 to 50 μm.

As the method of forming the penetrating electrodes 33, for example, it is possible to form penetrating holes in advance in the insulating layer 31 by laser drilling, and to electroplate the inside of the penetrating holes to form plated-through holes. FPC substrate formed by a metal film such as CU is provided on a polyimide film. In this case, the penetrating electrodes 33 can be formed by making an opening in the polyimide film from a side opposite to the metal film, the opening reaches the metal film, by laser drilling and growing metal from the metal film in the penetrating hole. When not forming the multilayer electrodes 34, the penetrating electrodes 33 formed by growing and protruding from the upper surface of the polyimide film, can form so called bump. It is desirable to make sure the connection to have electrical connection by a pressure adhesion.

Here, as the insulating layer 31, Cu was formed with a thickness of 5 μm using sputtering equipment on both surfaces of a polyimide film with a thickness of 25 μm in which the penetrating electrodes 33 had been formed in advance.

Figure 7:
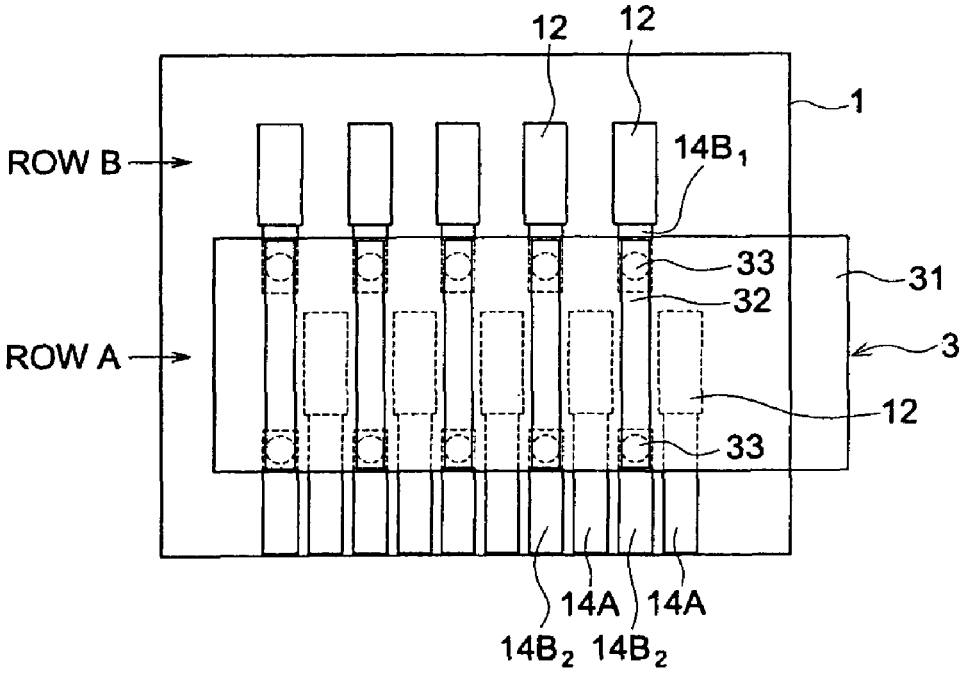
FIG. 7 is a diagram explaining an example of manufacture of an inkjet head.

Next, this large size multilayer member 3 formed in this manner is positioned so that the surface on which the multilayer electrodes 34 are formed is in contact with the back surface of the head chip 1, and also, each multilayer electrode 34 is electrically connected with the corresponding first connection electrode 14$B_1$ and second connection electrodes 14$_1$B, and the two are bonded together using an adhesive material (FIG. 7).

Here, an epoxy type adhesive material (Epotech 353ND manufactured by Epoxy Technologies Inc.) was used as the adhesive material, and the hardening conditions were 100° C. for 30 minutes and the pressure was 10 kg/cm$^2$.

The electrical conduction between the multilayer electrodes 34 and the first connection electrodes 14$B_1$ and the second connection electrodes 14$B_2$ at the time of bonding the multilayer member 3 are carried out using the NCP (Non Conductive Paste) method in which the electrical connection is achieved by pressure bonding metal films together using an adhesive. In this case, the epoxy type adhesive material not only functions as the adhesive material for the multilayer member 3, but also functions as an NCP. In the case of the NCP method, since it is sometimes difficult to obtain the electrical connection if the surface of the metal film is oxidized, it is desirable that the surfaces of the first connection electrodes 14$B_1$ and the second connection electrodes 14$B_2$ for row B are some metal such as Au, Pt, etc., that are difficult to oxidize, and this can be realized by making the metal film have multiple layers.

Further, it is also possible to use the ACP (Anisotropic Conductive Paste) method of using an adhesive material in which metal particles have been dispersed. In this case, since the metal particles penetrate the oxide films on the metal films and get connected, it is easily possible to obtain definite electrical connection even if the first connection electrode 14$B_1$ and the second connection electrode 14$B_2$ for row B are made of some metal such as Al whose surface is prone to get oxidized.

In particular, in the present invention, obtaining electrical conduction between the connection electrodes 14B for row B and the drawing out wirings 32B for row B of the multilayer member 3 by forming penetrating electrodes 33 in the insulating layer 31, and using an adhesive material having metal particles (electrically conductive particles) is most desirable for aiming to obtain definite electrical connection between the two.

Further, in addition to the method, after patterning the different wirings 32 in the insulating layer 31 of a large size in this manner, of bonding to the back surface of the head chip 1 the multilayer member 3 as it is with a large size, it is also possible to form the different wirings 32 by patterning using etching after bonding to the back surface of the head chip 1 the multilayer member 3 before patterning in which a film of a metal such as Cu, etc., has been formed on the entire surface of the surface that is opposite to the surface that is bonded to the head chip 1. Even in this case, the penetrating electrodes 33 and multilayer electrodes 34 are formed in advance.

In this case, although the pattern is transferred using a photo mask, the position adjustment of the photo mask relative to the head chip 1 is carried out using an exposure apparatus, it is possible to carry out position adjustment to a position accuracy of several μm, and it is possible to obtain high accuracy that cannot be obtained with other methods. In addition, according to this method, because of the presence of a metal film that is formed on the entire surface, even if expansion occurs in the insulating layer 31 due to the application of heat and pressure during bonding the large size multilayer member 3, since the patterning of the wiring 32 is made thereafter at the prescribed positions, there is the advantage that there is no possibility of any position shift occurring with respect to the first connection electrodes 14$B_1$ and the second connection electrodes 14$B_2$.

Next, dry etching is done of the multilayer member 3 from the back surface of the head chip 1, and the unnecessary insulating layer 31 is removed from the large sized multilayer members 3. As a concrete method of dry etching, it is possible to select appropriately according to the plastic that is used for the insulating layer 31. For example, if a polyimide film is used as in the case of the present preferred embodiment, it is possible to carry out dry etching using oxygen plasma. Here, a parallel plate type RF plasma equipment is used as the oxygen plasma equipment, and after evacuating to get a vacuum, oxygen gas of 50 sccm was introduced, and the pressure was made 10 Pa by adjusting the valve. An RF with a frequency of 13.56 MHz and a power of 500 W was applied, and the polyimide was dissociated and removed by the oxygen plasma that was generated thereby. The polyimide can be removed in about 10 minutes. At this time, since the wirings 32 on the front surface are not dissociated by the oxygen plasma, these wirings 32 become a mask, and the insulating layer 31 under them does not get etched but remains as it is.

Further, although wet etching can also be used as the etching method, dry etching is desirable since normally the wet etching liquid is acidic or basic and is likely to corrode the drive electrodes 13. Furthermore, in case even if some oozing out of the adhesive material is present at the time of bonding the multilayer member 3, since it is possible to dissociate and remove unnecessary adhesive material simultaneously at the time of dry etching, the problem of excess adhesive material clogging the channels or covering the surfaces of electrodes is solved.

In addition, since the insulating layer 31 is removed entirely except at the parts where it is masked by the drawing out wirings 32B for row B, at the stage of bonding to the back surface of the head chip 1, it is also possible to make the shape of the insulating layer 31 larger than the back surface of the head chip 1, and by making it have a large size so that it protrudes outward beyond the head chip 1 as shown in FIG. 6*a*, FIG. 6*b*, and FIG. 7, it is possible to carry out the bonding operation while holding the parts of the insulating layer 31 that are protruding outwards beyond the head chip 1, and there is the advantage that the ease of operation is far superior. In the example shown in the figure, although the insulating layer 31 of the multilayer member 3 has been formed so that it protrudes outward on the right side as seen from the back surface of the head chip 1, it is also possible to form it so that it protrudes outward either in one direction or in both directions towards the top, bottom, left, or right in the figure.

Further, the method of dry etching need not be restricted to the above method, but can be selected appropriately.

Because of this, on the back surface of the head chip 1, the multilayer members 3 remaining after dry etching, which are made of the insulating layer 31, the wirings 32 the penetrating electrodes 33, and the multilayer electrodes 34, are placed individually for each channel 12 of row B as shown in FIG. 1, and the first connection electrode 14$B_1$ and the second connection electrode 14$B_2$ for row B are connected electrically to each other while passing between the channels 12 of row A.

Further, the drive electrodes 13 have not been shown in FIG. 5 and FIG. 7.

The concrete means for electrically connecting the connection electrodes 14A for row A and the second connection electrodes 14$B_2$ for row B that are arranged in parallel at one edge part in the back surface of such a head chip 1 and the drive circuits (not shown in the figure) is not particularly stipulated, and it is possible to use various means. For example, as shown in FIGS. 2*a* and 2*b*, by joining an interconnection substrate 4, it is possible to carry out electrical connection between the connection electrodes 14A for row A and the second connection electrodes 14$B_2$ for row B that are arranged in parallel at one edge part in the back surface of such a head chip 1 and the drive circuits (not shown in the figure).

As the interconnection substrate 4, it is possible to form a plate shaped substrate using a ceramic material such as non-polarized PZT, or AlN—BN, AlN, etc. Further, it is also possible to use plastics or glass having low thermal expansion. In addition, it is desirable to use the same substrate material as that used for the piezoelectric device substrate used in the head chip 1 but after depolarization. In addition, in order to suppress the generation of deformation, etc., of the head chip 1 due to differences in thermal expansion, it is more desirable to select the material so that the difference in the thermal expansion coefficients is within ±1 ppm. The material forming the interconnection substrate need not be limited to a single plate, but it is possible to stack a plurality of sheets of thin plate shaped substrate materials so as to obtain the desired thickness.

The interconnection substrate 4 extends in a direction (the up/down direction in FIGS. 2*a* and 2*b*) at right angles to the direction of the channel rows in the head chip 1, and has the projecting parts 41*a* and 41*b* that project by a large distance respectively from the top surface and the bottom surface of the head chip 1. Further, in the surface that is joined to the back surface of the head chip 1, a single groove part 42 has been formed that extends over its width direction (the direction of the channel rows). This groove part 42 has been formed with a size so that it can cover the opening parts 122 on the back surfaces of all the channels 12 along the channel row directions of both row A and row B of the head chip 1, and forms an ink supply chamber that supplies ink commonly to each of the channels of row A and row B.

In other words, the height of the groove part 42 in the up/down direction in the figure is larger than the height of the head chip 1 along each of the channel rows of row A and row B on the back surface of the head chip 1, but is smaller than the thickness of the head chip 1 along a direction at right angles to the direction of the channel rows. Because of this, when the interconnection substrate 4 is joined to the back surface of the head chip 1, all the channels 12 of each of the channel rows of row A and row B fit inside the groove part 42. Further, each of the multilayer members 3 also fit inside this groove part 42.

In the projection part 41*b* at the bottom part in the figure of the interconnection substrate 4, the same number of interconnection electrodes 43 as the number of connection electrodes 14A for row A and second connection electrodes 14$B_2$ for row B provided in parallel at the bottom edge part on the back surface of the head chip 1 have been formed with the same pitch. The interconnection substrate 4 is bonded to the back surface of the head chip 1 using an anisotropic conductive paste, etc. so that the edge parts towards the groove part 42 of each of the interconnection electrodes 43 are connected electrically with the connection electrodes 14A for row A and the second connection electrodes 14$B_2$ for row B.

Further, although it is possible to supply ink to the groove part 42 either from both ends or from any one end of the groove part 42 when the interconnection substrate 4 is joined to the back surface of the head chip 1, it is also possible to connect additionally an ink manifold not shown in the figure on the back surface side of this interconnection substrate.

In this manner, according to the present invention, since the connection electrodes 14A for row A that are electrically connected to the drive electrodes 13 inside each of the channels 12 of row A and the second connection electrodes 14$B_2$ that are electrically connected to the drive electrodes 13 inside each of the channels 12 of row B via the wirings 32 and the first connection electrodes 14$B_1$ are provided in one row at one edge part on the back surface of the head chip 1, it is possible to carry out the electrical connections between the drive electrodes 13 inside all the channels 12 of row A and row B with the drive circuits at only one edge part on the back surface of this head chip 1.

Furthermore, although the wirings 32 are drawn out up to the edge part of the head chip 1 by passing between the neighboring channels 12 of the row A of channels, since the insulating layer 31 is present in between the drive walls 11 between the channels 12 of row A, the wirings 32 do not directly contact the drive walls 11, and the drive wall will not have any electrostatic capacitance due to the voltage applied to the wirings 32. In addition, since they also do not come into contact with the drive electrodes 13 inside the channels 12 of row A, it is not necessary to make the wirings 32 have unnecessarily narrow widths, and it is possible to reduce the likelihood of open circuits.

However, in the head chip 1, since the drive electrodes 13 inside the channels 12 come into direct contact with the ink, in case water based inks are use, a protective film becomes necessary on the surfaces of the drive electrodes 13. Further, since even the lead wirings 32B for row B of the multilayer member 3 come into direct contact with the ink, in case solvent based inks are used, protective films become necessary for protecting these from solvents. In view of this, after joining the multilayer member 3 to the back surface of the head chip 1, it is desirable to form a protective film on all the surfaces of the head chip 1, that is, on the surfaces of each of the drive electrodes 13 and on the surfaces of the multilayer member 3.

As a protective film, it is desirable to carry out coating using a film made of para-xylylene and its derivatives (hereinafter referred to as parylene films). Parylene films are plastic coatings made of plastics of poly-para-xylylene dimer and/or its derivatives, and are formed by the CVD (Chemical Vapor Deposition) method using a solid para-xylylene dimer or its derivatives as the evaporation source. In other words, para-xylylene radicals generated by the evaporation and thermal dissociation of para-xylylene dimer adhere to the surface of the head chip 1 and carry out polymerization reaction to form a covering film.

There are various types of parylene films, and depending on the necessary performance, it is possible to use as the desired parylene film different types of parylene films or a parylene film with a multiple layer structure in which a plurality of layers of different types of parylene films are superimposed on one another. It is desirable to make the film thickness of such a parylene film from 1 μm to 10 μm.

Since parylene films can penetrate even very fine regions and form coating films, by forming the coating film on the head chip 1 before joining the nozzle plate 2, not only the drive electrodes 13 but also a part of the connection electrodes 14A for row A which are exposing outside, a part of the first connection electrodes 14$B_1$, a part of the second connection electrodes 14$B_2$ and a part of the wirings 32 gets covered with the parylene film and is protected from the ink. Due to this formation of parylene films, the surface of the multilayer member 3 is protected and its durability is improved.

In the case that a parylene film is formed in this manner, the nozzle plate 2 is joined thereafter.

Further, when joining the interconnection substrate 4 to the back surface of the head chip 1, the parylene film described above is formed before bonding the nozzle plate 2 to the head chip 1 but after bonding the interconnection substrate 4 to the head chip 1. Because of this, in addition to ensuring the electrical connection between the different electrodes, it is also possible to protect the adhesive layer between the interconnection substrate 4 and the head chip 1.

Second Preferred Embodiment

Figure 8:
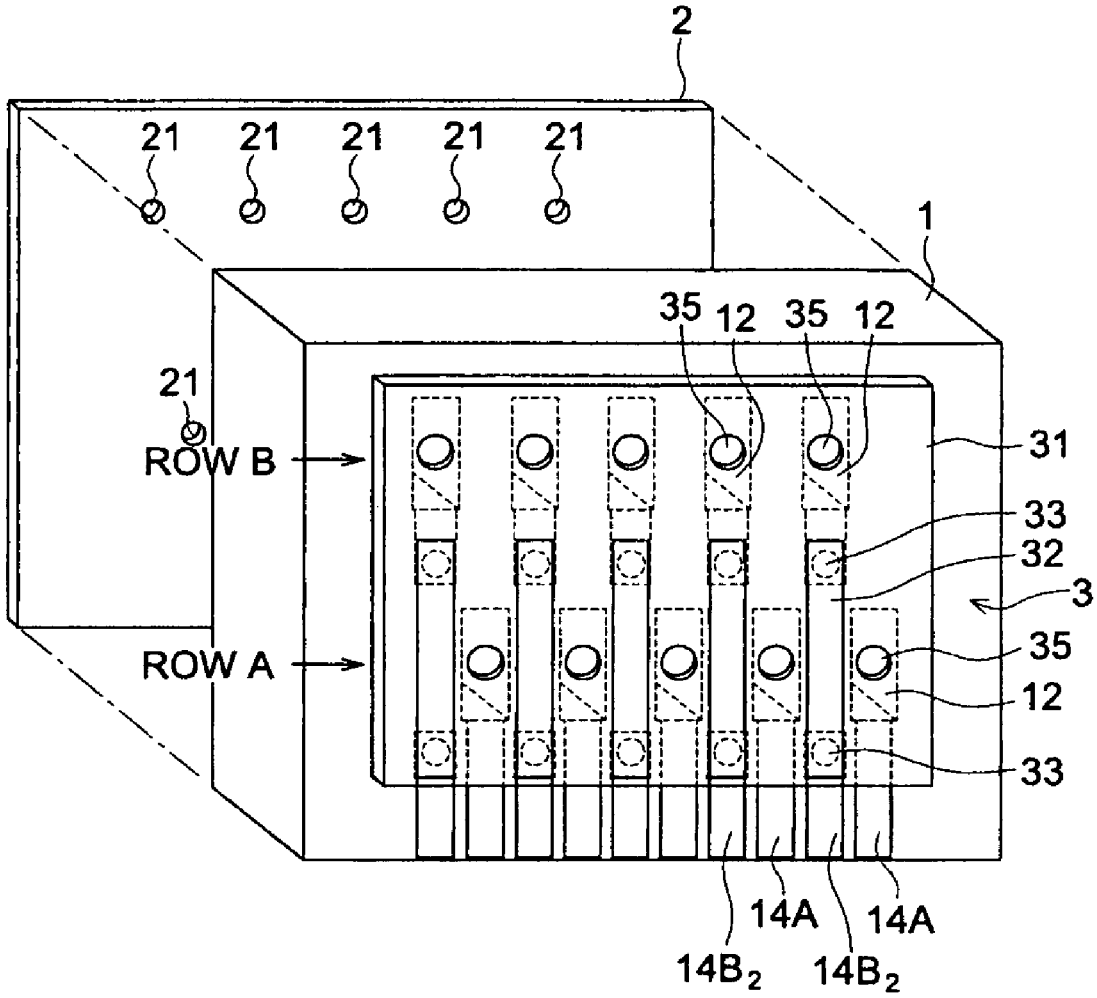
FIG. 8 is a perspective view diagram of an inkjet head according to a second preferred embodiment as seen from the side of the back surface.

FIG. 8 is a perspective view diagram of an inkjet head according to a second preferred embodiment as seen from the side of the back surface. Since the same symbols as in FIG. 1 indicate the same structure, their detailed explanations are omitted.

In this second preferred embodiment, the multilayer member 3 has not been separated into individual units but has been joined to the back surface of the head chip 1 in the form of a single large shape that covers all the channels 12 of the head chip.

Because of this, although all the channels 12 that open at the back surface of the head chip 1 are closed by the insulating layer 31 of the multilayer member 3, similar to the first preferred embodiment, since all the channels 12 in the head chip 1 are ejecting channels that eject ink, ink flow inlet holes 35 for making the ink flow into each channel 12 have been opened individually in each channel 12 by laser machining or etching, etc. The shapes of the ink flow inlet holes 35 are not particularly stipulated. Each channel 12 can restrict the inflow of ink into the channel using these ink flow inlet holes 35 with a size smaller than that of the openings of each channel 12. The ink flow inlet holes 35 in this case can also function as flow path restricting holes that restrict the flow path of ink to the channels 12.

According to this second preferred embodiment, in addition to the effects similar to those of the first preferred embodiment, there is the advantage that, using the insulating layer 31 of the multilayer member 3, it is possible to easily form the flow path restricting holes that restrict the inflow of ink into each of the channels 12.

Third Preferred Embodiment

Figure 9:
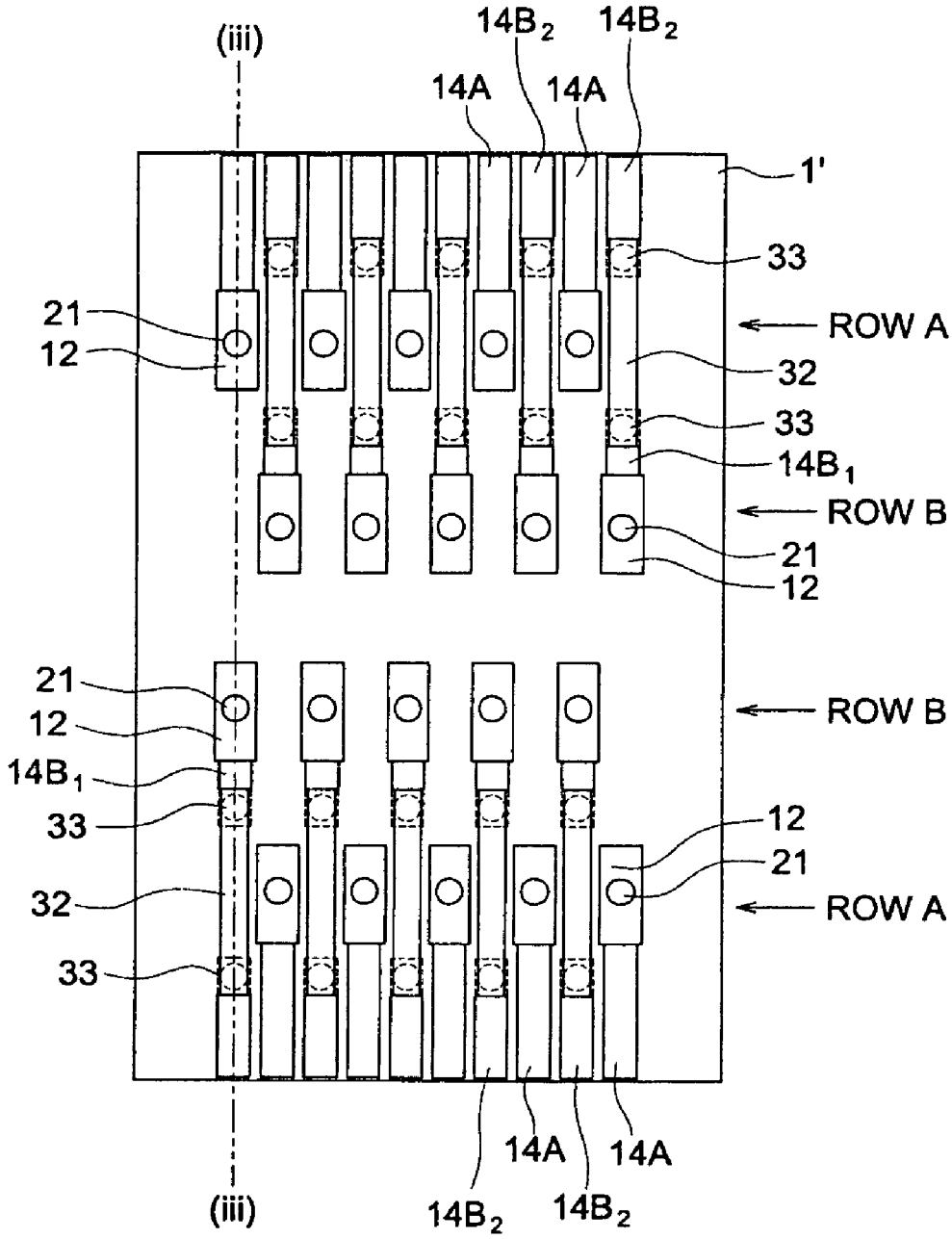
FIG. 9 is a rear view diagram of an inkjet head according to a third preferred embodiment.
Figure 10:
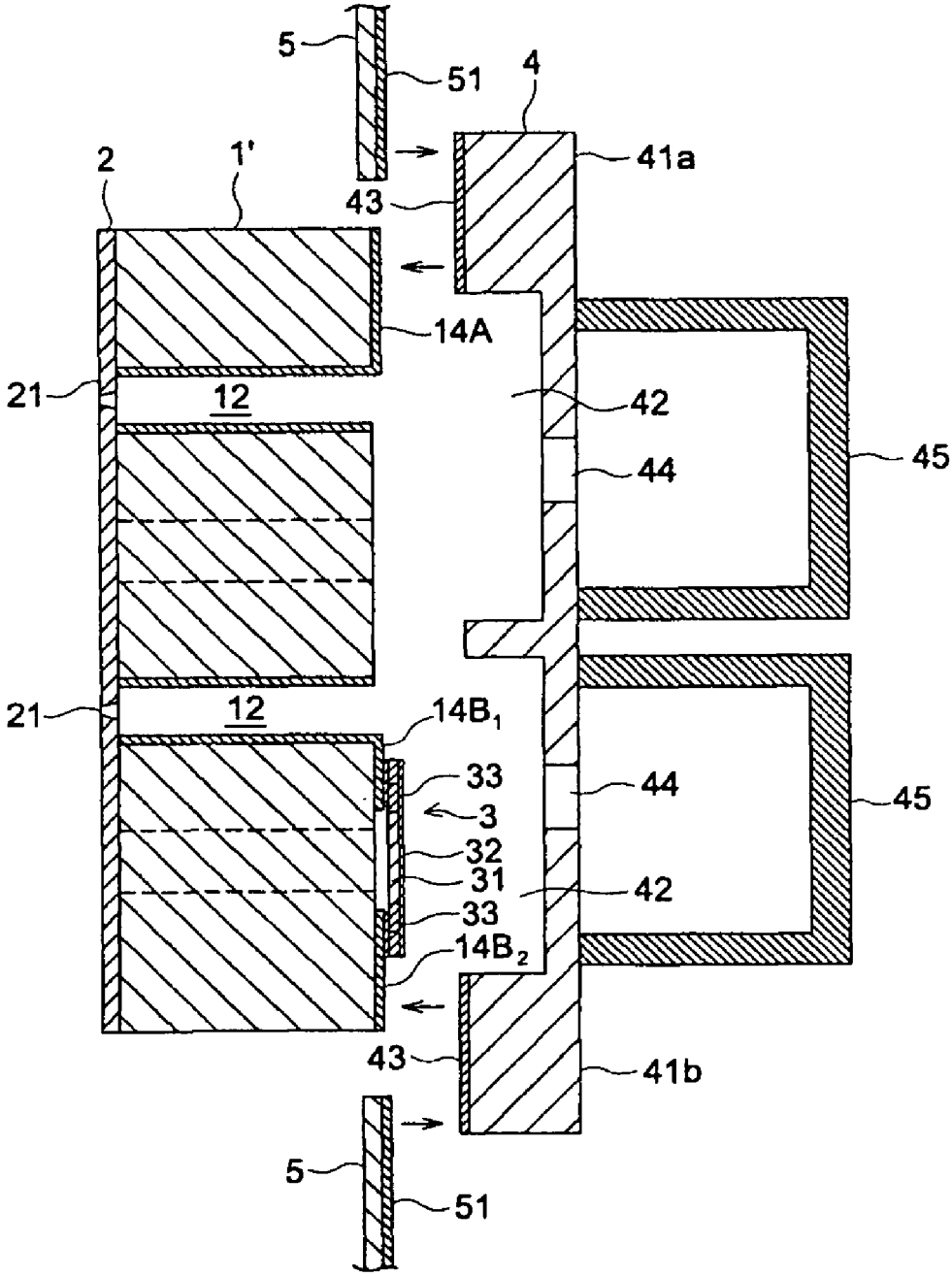
FIG. 10 is a cross sectional view diagram at (iii)-(iii) of FIG. 9.

FIG. 9 is a perspective view diagram of an inkjet head according to a third preferred embodiment as seen from the side of the back surface, FIG. 10 is a cross sectional view diagram at (iii)-(iii) of FIG. 9. Since the same symbols as in FIG. 1 indicate the same structure, their detailed explanations are omitted. In addition, the adhesive material layer has not been shown in the cross sectional view diagrams.

The inkjet head chip 1' of the inkjet head according to the third preferred embodiment, 4 rows of channels are provided. In a case of 4 rows, 2 rows of channels positioned outside are determined as row A respectively, and 2 rows of channels sandwiched by the two rows A and positioned inside are determined as row B respectively. Connection electrodes for row A and connection electrodes 14$B_2$ for row B are provided at upper and lower ends of the head chip 1'.

As a consequence, the electrical connection of the interconnections for driving for applying the drive voltages from the drive circuits to the drive electrodes inside the different channels can be carried out respectively at the top and bottom edge parts of the head chip 1'. In this case, by forming the interconnection electrodes 43 respectively in the projection parts 41*a* and 41*b* that project from the top and bottom of the head chip 1, it is possible to carry out respectively the connections with FPC 5 at both the top and bottom edge parts of the interconnection substrate 4.

Further, this groove part 42 of the interconnection substrate 4 has been formed by dividing it into two parts so that two channels rows each of the channel rows of the head chip 1' are included respectively in them. Therefore, if inks of different color are supplied to the inside of the two groove parts 42 and 42, it is possible to eject inks of two different colors from one head chip 1'. Here, in each of the groove parts 42 and 42, opening parts 44 and 44 are provided respectively, and due to these opening parts 44 and 44, it is possible to supply inks respectively from the independent ink manifolds 45 and 45. When it is sufficient for the head chip 1' to eject ink of only one color, only one groove part 42 with a size that can include all the four channel rows can be provided in the interconnection substrate 4, or else, on the back surface of the interconnection substrate 4, it is possible to join only a single large ink manifold that includes the two groove parts 42 and 42 and the two opening parts 44 and 44 that communicate with them respectively.

Further, even in the second preferred embodiment, in a similar manner, it is possible to construct an inkjet head having four rows of channels.

Other Forms of the Multilayer Member:

In the above preferred embodiments, although the electrical connection among the first connection electrodes 14$B_1$, the second connection electrodes 14$B_2$ for row B, and the wirings 32 were achieved by the penetrating electrodes 33, or desirably, by the penetrating electrodes 33 and the multilayer electrodes 34, it is not necessary to limit to these, and it is possible to adopt various other methods as long as the electrical connections between the two of them is obtained.

For example, it is also possible to remove at least a part of the insulating layer 31 in the region where the first connection electrodes 14$B_1$ for row B and the wirings 32 of the multilayer member 3 overlap each other and in the region where the second connection electrodes 14$B_2$ for row B and the wirings 32 of the multilayer member 3 overlap each other as shown in FIGS. 11*a*, 11*b*, 12*a*, and 12*b*, and to form the removed parts 31*a* in which that insulating layer 31 has been removed.

Figure 11A:
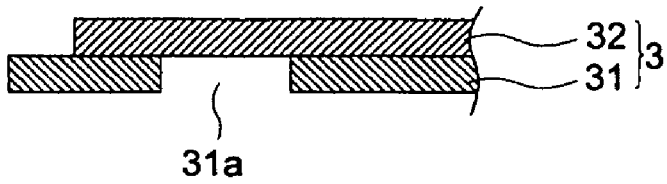
FIG. 11*a* is a cross sectional view diagram showing a multilayer member with a removed part formed in it.
Figure 11B:
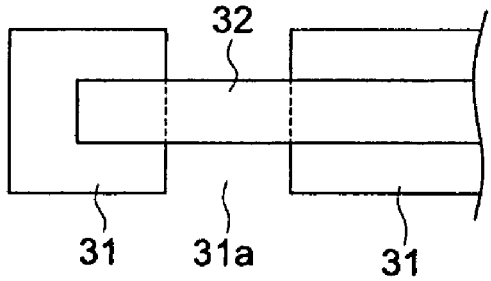
FIG. 11*b* is a plan view diagram showing a multilayer member with a removed part formed in it.
Figure 12A:
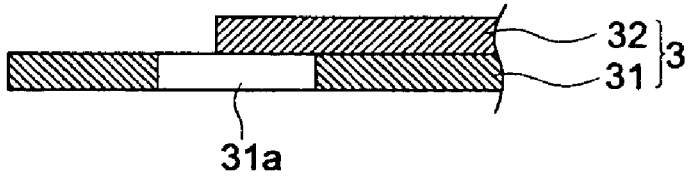
FIG. 12*a* is a cross sectional view diagram showing another form of a multilayer member with a removed part formed in it.
Figure 12B:
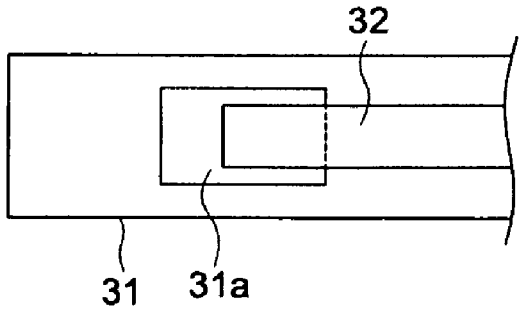
FIG. 12*b* is a plan view diagram showing another form of a multilayer member with a removed part formed in it.

FIG. 11*a* is a cross sectional view of the multilayer member 3 in an example in which a removed part 31*a* is formed by removing a part of the insulating layer 31 so as to split it into two parts, FIG. 11*b* is a plan view diagram showing that part, FIG. 12*a* is a cross sectional view of the multilayer member 3 in an example in which a removed part 31*a* is formed by removing a part of the insulating layer 31 so that rectangular shaped opening is formed in it, and FIG. 12*b* is a plan view diagram showing that part. By forming removed parts 31*a* in the multilayer member 3 in this manner, at the removed parts 31*a*, the wiring 32 on the top surface of the insulating layer 31 faces the bottom surface of the insulating layer 31.

The removed part 31*a* can be formed, after the pattern formation of wiring 32 is made on the insulating layer 31, by selective etching from the side of the insulating layer 31.

Figure 13A:
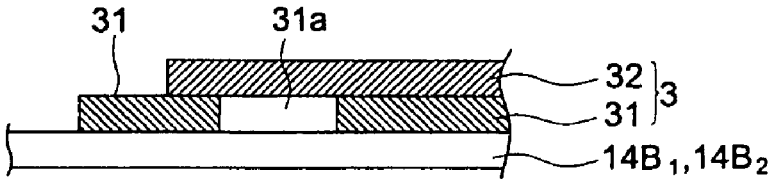
FIGS. 13*a* to 13*c* are cross sectional view diagrams for explaining the manner in which electrical connection is achieved by the multilayer member shown in FIGS. 11*a* to 12*b*.
Figure 13B:
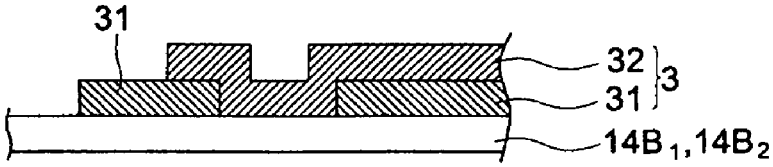
Figure 13C:
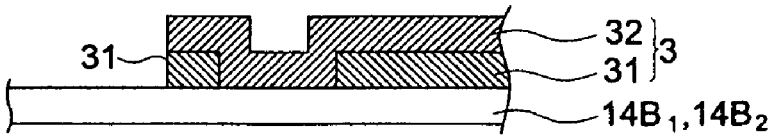

The method of achieving electrical conduction between the first connection electrodes 14$B_1$ and the second connection electrodes 14$B_2$ for row B using a multilayer member 3 having these types of removed parts 31*a* is shown in FIGS. 13*a* through 13*c*.

Firstly, after positioning the removed part 31*a* of the multilayer member 3 so as to come above the first connection electrodes 14$B_1$ and the second connection electrodes 14$B_2$ for row B (FIG. 13*a*), the heat and pressure are applied to the top part of the removed part 31*a* and the wiring 32 is made to come into direct contact with the first connection electrodes 14$B_1$ and the second connection electrodes 14$B_2$ for row B (FIG. 13*b*). After that, unnecessary insulating layer 31 is removed by carrying out dry etching (FIG. 13*c*). Because of this, even if the penetrating electrodes are not been formed, it is possible to achieve electrical conduction among the first connection electrodes 14$B_1$ and the second connection electrodes 14$B_2$ for row B, and the wiring 32.

In this method of forming removed parts 31*a* in the multilayer member 3, when the removed part 31*a* is formed in the insulating layer 31, since the condition will be one in which only the wiring 32 is remaining in the removed part 31*a*, a certain amount of film thickness and strength are necessary in the wirings 32. It is desirable to form a Cu thin film with a thickness of about 20 μm as the metal film forming the wirings 32 in this case. In addition, in order to enhance the reliability of connections, it is desirable to carry out Ni/Au electroplating.

Figure 14:
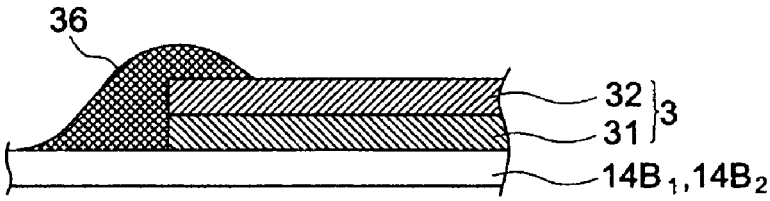
FIG. 14 is a cross sectional view diagram for explaining another form of achieving electrical connection by a multilayer member.

Further, as another method of achieving electrical connection among the first connection electrodes 14$B_1$, the second connection electrodes 14$B_2$ for row B, and the wirings 32, as shown in FIG. 14, after a multilayer member 3 that does not have penetrating electrodes is adhered to the back surface of the head chip 1, and after unnecessary insulating layer 31 is removed by dry etching, by coating an electrically conductive adhesive material 36 extending at the edge part of the multilayer member 3 so as to extend over the wirings 32, the first connection electrodes 14$B_1$, and the second connection electrodes 14$B_2$ for row B, it is also possible to achieve electrical conduction between them. It is desirable that the electrically conductive adhesive material 36 has resistance to solvents, and it is desirable that the electrically conductive adhesive material 36 has as its constituent an epoxy based adhesive material. In addition, instead of an electrically conductive adhesive material 36, it is also possible to achieve electrical conduction by coating in a similar manner a low melting point solder.

Figure 15:
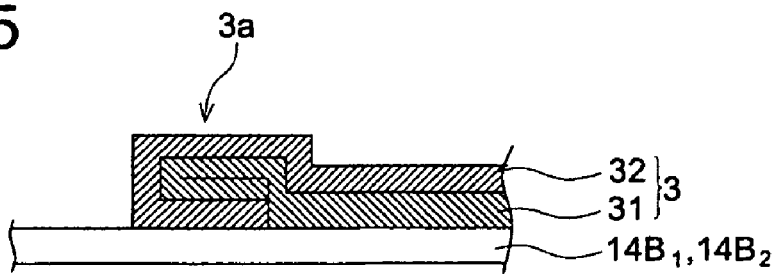
FIG. 15 is a cross sectional view diagram for explaining yet another form of achieving electrical connection by a multilayer member.

In addition, as another method, as shown in FIG. 15, it is possible to form a bent portion 3*a* of the multilayer member 3 by bending towards the inside the insulating layer 31 so that the wiring 32 gets exposed. By connecting after positioning the bent portion 3*a* over the first connection electrodes 14$B_1$ and the second connection electrodes 14$B_2$ for row B, it is possible to achieve electrical conduction similar to the cases of FIGS. 13*a* through 13*c*.

These multilayer members 3 need not be separated individually for each channel 12, and it is also possible to form a single large sized multilayer member 3 on the back surface of the head chip 1.

Figure 16:
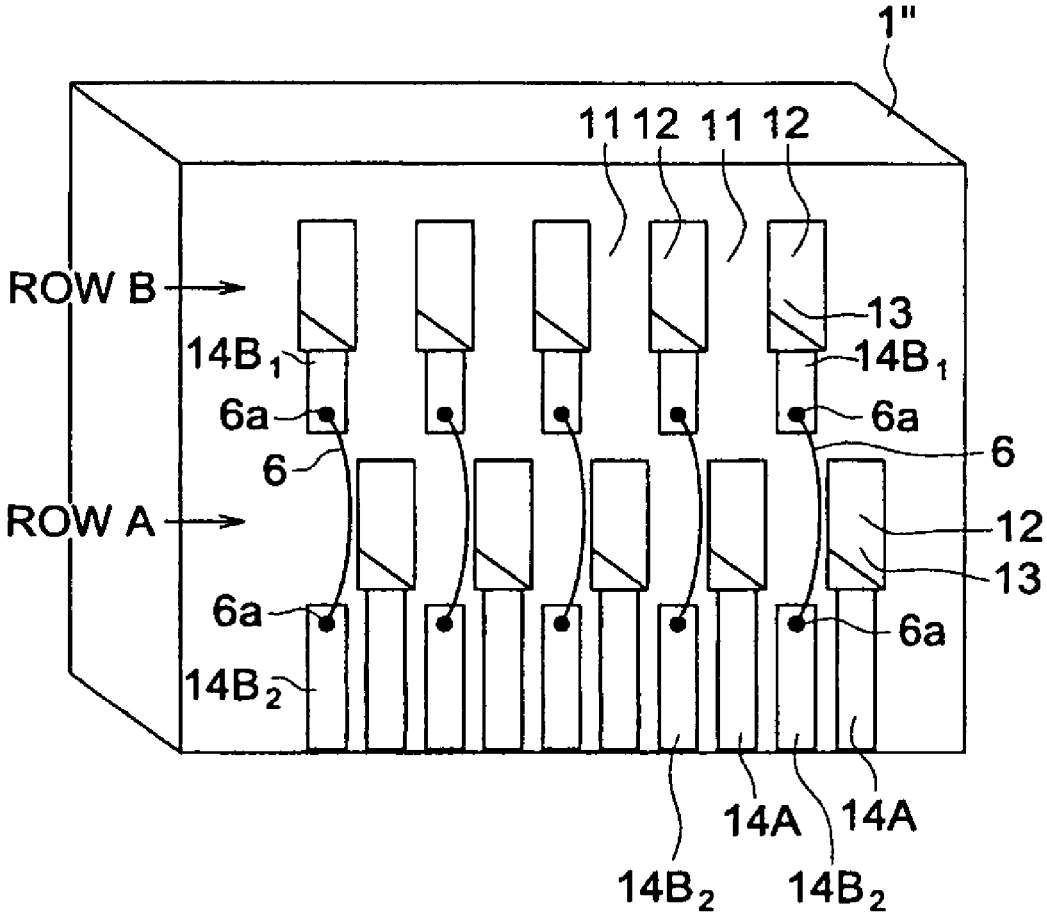
FIG. 16 is a perspective view diagram as seen from the back surface the head chip part of an inkjet head showing the form for electrically connecting a first connection electrode for row B with a second connection electrode.

Other Forms of Interconnections:

FIG. 16 shows yet another form for electrically connecting the first connection electrodes 14$B_1$ and the second connection electrodes 14$B_2$ for row B, and a head chip 1" is shown here in which the two are electrically connected to each other by an interconnection 6 using the wire bonding method. By forming such an interconnection 6 using the wire bonding method, since it is possible to make the interconnection between the first connection electrodes 14$B_1$ and the second connection electrodes 14$B_2$ for row B with a prescribed loop height, other than the contacts with the first connection electrodes 14$B_1$ and the second connection electrodes 14$B_2$ for row B, there is no direct connection with the back surface of the head chip 1", the drive wall 11 of the channels of row A does not come to have electrostatic capacitance, and there is no possibility of any short circuit with other electrodes.

As a wire bonding method, it is possible to use either of the methods of ball bonding and wedge bonding. Also, it is possible to use ordinary metal wires that can be wire-bonded for the interconnections 6, and it is possible to use for example, Al, CU, Au, Ni, etc.

When the interconnections 6 are formed in this manner using the wire bonding method, in the head chip 1", it is desirable that the regions corresponding respectively to the bonding parts 6*a* where the edge parts of the interconnection 6 are being connected respectively to the first connection electrode 14$B_1$ and the second connection electrode 14$B_2$ for row B are formed from a non-piezoelectric material. This is because, since these bonding parts 6*a* are formed during bonding by the collision of a capillary or a wedge tool, there is the possibility of damage to the head chip 1 if these parts are made of a piezoelectric material which is weak to shocks. This is possible using a non-piezoelectric material for the substrate 100 shown in FIGS. 3*a* through 3*c* at the time of manufacturing the head chip 1".

As a non-piezoelectric material, although it is possible to use generally a plate shaped substrate made of a ceramic material, it is also possible to use plastics or glass with a low thermal expansion. In addition, in order to suppress the generation of deformation, etc., of the head chip 1 due to differences in thermal expansion, it is more desirable to select the material so that the difference in the thermal expansion coefficient with the piezoelectric material with which are formed the different drive walls 11 is within ±1 ppm.

Even when the interconnections 6 are formed by wire bonding in this manner, it is desirable to form a protective film on the surfaces of these interconnections 6 by coating a film of paraxylylene or its derivatives as has been described above.

Although explanations were given for the shear mode type inkjet head in which ink inside a channel 12 is ejected out by causing shear deformation of the drive wall 11 in each of the above preferred embodiments, the present inventions shall not be limited to shear deformation of the drive wall 11.

What is claimed is:

1. An inkjet head comprising:

a nozzle plate comprising a plurality of nozzles;

a head chip comprising:

a plurality of rows of channels arranged in parallel to each other, wherein each row of the plurality of rows of channels comprises a plurality of channels arranged in parallel to each other, and a plurality of driving walls each made of piezoelectric member, wherein each of the plurality of channels and each of the plurality of driving walls are provided alternately;

a plurality of drive electrodes provided in each of the plurality of channels, wherein the drive walls are deformed to eject ink from the plurality of nozzles by applying a drive voltage to each of the plurality of electrodes;

wherein neighboring rows of the plurality of rows are placed so that they are shifted from each other by half a pitch of the channels of the neighboring rows, and each of the plurality of channels are provided with an opening on a front surface of the head chip and an opening on a back surface of the head chip;

wherein all the channels of the plurality of channels are ejecting channels that eject ink;

wherein when assuming that one of the plurality of rows of channels provided on a side of an end of the head chip is row A and another of the plurality of rows of channels provided next to row A is row B, on the back surface of the head chip, a plurality of connection electrodes for row A that conduct electrically to a plurality of drive electrodes for row A are respectively arranged extending from each of the plurality of channels of row A to the end of the head chip with a pitch equal to the pitch of the channels of row A, and a plurality of first connection electrodes for row B that conduct electrically to a plurality of drive electrodes for row B are respectively arranged between each of the plurality of channels of row A and each of the plurality of channels of the row B with a pitch equal to the pitch of the channels of row B; and wherein a plurality of second connection electrodes for row B are arranged between neighboring connection electrodes for row A among the plurality of connection electrodes for row A with a pitch equal to the pitch of the plurality of first connection electrodes, separately from the plurality of first connection electrodes; and a plurality of wirings adapted to electrically connect the first connection electrodes and the second connection electrodes respectively, wherein the plurality of wirings arranged not to contact the back surface of the head chip except for the first connection electrodes and the second connection electrodes.

2. The inkjet head of claim 1, wherein the plurality of rows of channels is four rows, two rows provided on both sides of both ends of the head chip among the four rows are determined to rows A and two rows provided on the inner side among the four rows are determined to rows B.

3. The inkjet head of claim 1, wherein one of the plurality of wirings is formed on an insulating layer and constitutes a multilayer member with the insulating layer, wherein the multilayer member is adhered to one of the first connection electrodes and one of the second connection electrodes so as to contact the back surface of the head chip.

4. The inkjet head of claim 3, wherein the multilayer member comprises: a penetrating electrode that penetrates through the insulating layer in an area where the multilayer member overlap with one of the first connection electrodes; and a penetrating electrode that penetrates through the insulating layer in an area where the multilayer member overlap with one of the second connection electrodes, wherein said one of the first connection electrodes and said one of the second connection electrodes are electrically connected by conducting with said one of the plurality of wirings through the penetrating electrodes respectively.

5. The inkjet head of claim 3, wherein at least a part of the insulating layer of the multilayer member is removed in a region where one of the first connection electrodes and the multilayer member overlap each other and in a region where the second connection electrodes and the multilayer member overlap each other, and wherein said one of the first connection electrodes and said one of the second connection electrodes are electrically connected by conducting with said one of the plurality of wirings at the removed parts in which the part of the insulating layer has been removed.

6. The inkjet head of claim 3, wherein one of the first connection electrodes and one of the second connection electrodes are electrically connected by conducting with said one of the plurality of wirings with an electrically conductive adhesive material or a solder coated on a region where one of the first connection electrodes and the multilayer member overlap each other and on a region where the second connection electrodes and the multilayer member overlap each other.

7. The inkjet head of claim 3, wherein one of the first connection electrodes and one of the second connection electrodes are electrically connected by conducting with said one of the plurality of wirings at bent portions of the multilayer member formed by bending towards the back surface side of the head chip the both ends of the multilayer member on a region where one of the first connection electrodes and the multilayer member overlap each other and on a region where the second connection electrodes and the multilayer member overlap each other.

8. The inkjet head of claim 3, wherein the insulating layer of the multilayer member is made of an organic film that can be patterned by dry etching.

9. The inkjet head of claim 1, wherein the plurality of wirings is formed by wire bonding method.

10. The inkjet head of claim 9, wherein regions corresponding respectively to the bonding parts where the edge parts of the wirings are being connected respectively to the first connection electrode and the second connection electrode are formed from a non-piezoelectric material.

11. The inkjet head of claim 1, wherein the plurality of wirings is coated on its surface by a film of para-xylylene and its derivatives.

* * * * *